United States Patent [19]

Färber

[11] Patent Number: 4,930,683

[45] Date of Patent: Jun. 5, 1990

[54] PARALLELEPIPEDAL FLAT GABLED PACKAGE AND METHOD OF MANUFACTURE

[75] Inventor: Jürgen Färber, Kaarst, Fed. Rep. of Germany

[73] Assignee: PKL Verpackungssysteme GmbH, Dusseldorf, Fed. Rep. of Germany

[21] Appl. No.: 317,228

[22] Filed: Feb. 28, 1989

[30] Foreign Application Priority Data

Mar. 12, 1988 [DE] Fed. Rep. of Germany ..... 3808303

[51] Int. Cl.[5] ..... B65D 5/74

[52] U.S. Cl. ..... 229/125.09; 206/603; 220/258; 220/278; 229/125.14; 229/125.15

[58] Field of Search ..... 229/125.07, 125.08, 229/125.09, 125.14, 125.15, 125.17; 206/603, 626, 621.3, 621.7; 220/276, 278, 258; 215/253, 256; 222/541

[56] References Cited

U.S. PATENT DOCUMENTS

| | | | |
|---|---|---|---|
| 3,339,812 | 9/1967 | Meissner | 220/278 |
| 4,580,682 | 4/1986 | Gorski et al. | 220/258 |
| 4,593,830 | 6/1986 | Bullock | 215/256 |
| 4,682,706 | 7/1987 | Devore et al. | 220/276 |
| 4,735,337 | 4/1988 | Von Holdt | 220/276 |
| 4,807,787 | 2/1989 | Langmeier et al. | 222/541 |

FOREIGN PATENT DOCUMENTS

| | | | |
|---|---|---|---|
| 3416890 | 2/1985 | Fed. Rep. of Germany | 220/258 |
| 2119813 | 8/1972 | France | 220/258 |
| 531816 | 8/1955 | Italy | 220/278 |

OTHER PUBLICATIONS

Welt der Milch 40 (1986), 23, p. 696.

*Primary Examiner*—Gary Elkins

*Attorney, Agent, or Firm*—Sprung Horn Kramer & Woods

[57] ABSTRACT

A parallelepipedal flat-gabled package, especially an eared package with a medial seam, having an area in the gable that has been prepared such that it can be penetrated or separated along a closed curve and, once it has been penetrated or separated, will constitute a pouring hole. The package also has a plastic pour-out structure that has a flange surrounding the pouring hole, rigidly secured to the outer surface of the gable, and into the spout of which can be axially inserted a tube with a circumference that matches the closed curve. It also has a number of triangular teeth along the surface that faces the pouring hole, and a cap that can be repeatedly employed to close the spout, the inner surface of the package being coated with a hot-adhering film of plastic. The closure-flap cap is securely attached to the tube, by way of a connecting strip, and is articulated to the tab on the pour-out structure, which is in the form of a spout.

23 Claims, 3 Drawing Sheets

PARALLELEPIPEDAL FLAT GABLED PACKAGE AND METHOD OF MANUFACTURE

BACKGROUND OF THE INVENTION

The invention relates to a parallelepipedal flat-gabled package, especially an eared package with a medial seam, with an area in the gable that has been prepared such that it can be penetrated or separated along a closed curve and, once it has been penetrated or separated, will constitute a pouring hole, with a plastic pour-out structure that has a flange surrounding the pouring hole, rigidly secured to the outer surface of the gable, and into the spout of which can be axially inserted a tube with a circumference that matches the closed curve and with a number of triangular teeth along the surface that faces the pouring hole, and with a cap that can be repeatedly employed to close the spout, the inner surface of the package being coated with a hot-adhering film of plastic. The invention further relates to a method of manufacturing such parallelepipedal flat-gabled package.

Such conventional parallelepipedal packages as the Combibloc and Tetra Brik for example that are known from the state of the art and commonly employed for packaging liquids in conjunction with conventional cold, cold-sterile, hot, and aseptic filling, cannot be closed again once they have been opened.

Punching a pour-out and air-admission hole through the gable of a flat-gabled package during the manufacturing process and sealing it on both sides with a thin sheet of material has accordingly been proposed (EP No. 0 214 791). This system also involves a special intermediate layer that allows the package to be reclosed with an adhesive pull tab.

Once the package has been reclosed, however, it will no longer be either hygienic or tight due to traces of product that adhere to the intermediate layer subsequent to pouring, and it will even be impossible to reclose if the product is highly viscous.

Also known from the dairy journal Welt der Milch 40 (1986), 23, 696 is a flat-gabled package with a plug-like closure articulated to the top of the gable with its walls tapering toward the front. The plug can be inserted into and retracted out of a pour-out opening in the gabled top of the package, for which purpose its upper closure surface is provided with a ring and a tab.

A closure of this type cannot of course ensure adequate tightness because the plug cannot be reliably positioned against the relatively soft laminating material at the edge of the pour-out hole. Furthermore, even a low level of pressure against the ringed tab can cause the package to open unintentionally. Add to this that the vicinity of the pouring spout will no longer be hygienically covered once the package has been opened and that, at least if the product is highly viscous, the remainder will not readily flow back into the package once the pouring process has been completed, but will settle on or drip uncontrolled from the surface of the gable.

The same drawbacks are characteristic of the closure system described in U.S. Pat. No. 3 924 777, which also does not provide a continuous inner coating over the vicinity of the opening that is absolutely necessary for gas-tight and odor-tight packages.

It has in particular been necessary up to now to accept that non-gurgling and drip-free pouring cannot be attained with flat-gabled packages.

EP No. 0 167 095 A2 proposes a sloping-gabled package with a spout and snap-on lid integrated into a plastic pouring structure introduced into a punched-out hole in the gable from inside and sealed on the inside against an outside support. This approach, however, ensures only moderate sterility due to the blisters that can occur if the seal is not full-surface.

Known from in German No. 3 039 299 A1 is a sloping-gabled container with a three-part pour-out structure secured to the surface of its gable. The structure consists of a flange sealed to the surface of a cylindrical section perpendicular to the flange with a pouring tube that is divided on the inside by an L-shaped partition and slides back and forth axially inside its inner surface, and of a cap that can be applied to the upper end of the perpendicular section. The container is opened by removing the cap and forcing the inner pouring tube down until triangular teeth on its face penetrate the side of the gable. The penetration is limited by a terminating edge on the pour-out structure. This embodiment, however, is unfortunately very expensive.

However, since flat-gabled packages are intended to be stacked one on top of another, this requirement alone prevents the solutions employed for sloping-gabled packages from being applied to them. Another circumstance that prevents applying the principles to flat-gabled packages is that they must satisfy different requirements with respect to controlling and directing the flow of poured-out product.

Another unsatisfactory feature of the pour-out structure described in EP No. 0 167 095 A2 is its relatively small pour-out opening, which is not appropriate for highly viscous liquids.

Other drawbacks of the reclosable pour-out structure known from German No. 3 039 299 are that, since it opens toward the inside of the package, it can only be sterilized at great expense and risk along with the package itself and cannot be provided with a continuous inner coating to cover the vicinity of the pouring opening before the package is opened.

OBJECT OF THE INVENTION

The object of the present invention is accordingly to improve a flat-gabled package with an integrated pour-out structure to the extent that the aforesaid drawbacks are eliminated. The package is in particular appropriate for an aseptic packaging system in relation for example to packages made of an aluminum multilayer composite with a layer of plastic (polyethylene) over their inner surface. The package also satisfies the strictest demands with respect to sterility and hygiene without detriment to basic tightness while the pour-out hole is being punched into the composite. Finally, the reclosable pour-out structure is tightly and securely fastened to the package and allow non-gurgling and drip-free pouring.

This object is attained in accordance with the invention in a flat-gabled package of the aforesaid type by the improvement wherein the closure-flap cap is securely attached to the tube, preferably by way of a connecting strip, and is articulated to the tab on the pour-out structure, which is in the form of a spout. The flat-gabled package in accordance with the invention has several decisive advantages over the container, which can also be embodied in the form of a flat-roofed package, known from German No. 3 039 299 A1 and most nearly approaching the object of the present invention in relation to sterility and hygiene requirements.

First, the overall reclosable pour-out mount is in one piece and can be flat if the flangelike tab is connected flat against the outer surface of the gable, so that the stackability of the package is affected very little or not at all. When the packages are shrink-wrapped separately or in trays and stacked in several layers, any remaining discrepancies in height that cause problems can be compensated for or eliminated with spacers.

Second, the coating on the inner surface of the package is not interrupted by the pour-out structure, but the area punched out for the pouring opening can be covered on the inside or on both sides, preferably in the extruder but also in a film sealer, with a composite that matches the coating. The opening can alternatively be stamped halfway through the finished composite from outside. The basic tightness of the package, which is decisive for its gas tightness and odor tightness, will accordingly be unaffected on the whole because the pour-out structure is sealed or cemented to the finished composite from outside. Since the inner coating of the packages in accordance with the invention can be sealed to the overall inner surface, there is no risk of the blisters that can occur when sheets are not bonded together over their total surface, and sterility can be ensured along with retention of the residual sterilizing agent when the packages are employed in the aseptic field.

The collar of the spout cap on the closure flap in one embodiment of the invention is secured to a releasable safety ring in such a way that the ring keeps the face of the tube with triangular teeth away from the separating line or from the pouring hole in the gable. The safety ring preferably completely surrounds the collar of the spout. These two measures ensure hygiene in the vicinity of the opening of the unopened package because the overall vicinity of the pour-out opening is covered by the main part of the spout, which is itself tightly encapsulated in the safety ring. The safety ring also prevents to advantage the pouring opening from opening unintentionally subject to pressure on the folding cap in the form of a spacer.

A pull tab can be secured to the safety ring and can be pulled to extract the ring along a tear line. The pull tab facilitates opening the closure the first time. The pull tab can be secured where the closure-flap cap is fastened to the connecting strip on the safety ring with a tear notch, preferably next to it. Once the tear notch has been torn through and the safety ring ripped out along the tear line, pressure can be applied to the outside of the closure cap to force the tube toward the thus formed annular opening, and the teeth on the face of the tube will penetrate the coated pouring-hole opening, with the spout correctly guiding the tube until the incision has been made or until all the necessary openings have been cut open.

In one refinement of the invention, the spout and the pouring hole have a slightly oval and raindrop-shaped cross-section. This design allows air into the package and helps to shape the stream of liquid being poured out, even if the liquid is highly viscous.

The stream of liquid can be shaped and directed even more successfully if the spout is positioned in one corner of the surface of the gable and has a sharp-edged and drawn-out lip that extends beyond the edge of the narrow side of the package with its free end in the form of a rip-open edge. This measure prevents dripping once the pouring process has been terminated in that any liquid remaining in the vicinity of the spout will flow back into the package along the slope of the spout.

Hygiene can be ensured in the vicinity of the pouring opening once the package has been closed again if the closed closure-flap cap completely surrounds or completely covers the collar, including the rip-open edge. This measure effectively prevents contamination of the edges involved from the very beginning.

The connecting strip is a preferably three-part strap hinge that allows the closure-flap cap to pivot 180°.

Two refinements of the invention provide means for preventing the closure-flap cap from entering the stream of liquid being poured out. First, the strap hinge can be in the form of an articulated arm with two dead centers, one with the closure-flap cap closed and the other with the cap open (folded up). Second, the surface of the closure-flap cap that faces away from the pouring hole and the outer surface of the gable, which comes to rest when the cap is completely folded up or around, can have preferably strip-shaped supports that function as an adhesive closure.

The tube and the pouring channel inside the spout are preferably slightly conical. This measure ensures that the seal will be tight even when the package is shaken because the wall of the spout will not collapse.

To prevent the areas stamped out to create a pouring hole from falling into the package, the inside of the closure-flap cap can have a wedge or pin in the center of the tube and extending beyond the face of the tube or the edges. This refinement is especially practical in conjunction with the line punched halfway through the center of the eventual pouring hole from outside to be described hereinbelow.

In one cost-effective and easy to manufacture embodiment of the invention, the closure-flap cap and the tube, the pour-out structure consisting of the spout and the tab, and/or the connecting strip can be made of one piece of plastic, preferably a soft extruded plastic. The resulting flat integrated pouring structure can be functionally innovatively extruded around or on at the factory by deflecting the strap hinge 180° and beading the pull tab around or securing it to the spout. The flat pour-out structure can be applied to the flat gable either in the filling station or in application machinery downstream of the filling station.

The tab can be cemented or sealed to the outside of the gable.

The inner surface of the package is preferably coated with polyethylene that extends, before the package is opened, over the area that will become the pouring hole and over the line of separation.

The package can preferably be made of a multilayer aluminum composite, with a layer of polyethylene on the outside, followed by a layer of cardboard, another layer of polyethylene, a layer of aluminum, an adhesion promoter, and a third layer of polyethylene on the inside.

Before the package has been opened for the first time, the pouring hole can have a continuous coating of polyethylene extruded onto the outside and onto the inside but no layer of cardboard.

Before the package has been opened for the first time, the outside and inside of the pouring hole can be covered with thin sealed-on scents.

Before the package has been opened for the first time, the eventual pouring hole can consist of a layer of cardboard with a discontinuous ring punched into it, preferably leaving webs of material intact, and coated in the extruder.

Before the package has been opened for the first time, the eventual pouring hole can be punched halfway through in the shape of a ring from outside.

Especially when the inside of the closure-flap cap has a wedge or pin in the center of the tube and extending beyond the face of the tube or the edges, a line can be punched halfway through the center of the eventual pouring hole from outside.

These refinements collectively ensure to advantage that the packages can be conventionally shaped, filled, and sealed and that the integrity of the coating on the inner surface of the package will be maintained.

Another object of the invention is to improve the method of manufacturing the aforesaid flat-gabled packages. This object is attained in accordance with the invention by the improvement wherein either a raindrop shape is punched all the way through the uncoated cardboard while the blank is being manufactured and the shape is coated in the extruder or a raindrop shape is punched halfway through the coated composite and the tab is cemented or sealed over the punched-out or punched-in shape on the folded-up package in a step that is governed in accordance with register.

Once the tab has been cemented or sealed on, the closure-flap cap and the collar can be welded to the spout with the safety ring in between.

The packages can accordingly be manufactured economically and cost-effectively without essentially altering the conventional manufacturing and filling processes.

BRIEF DESCRIPTION OF THE DRAWINGS

The invention will now be explained in greater detail with reference to the drawings, wherein.

DETAILED DESCRIPTION OF THE INVENTION

Figure 1:
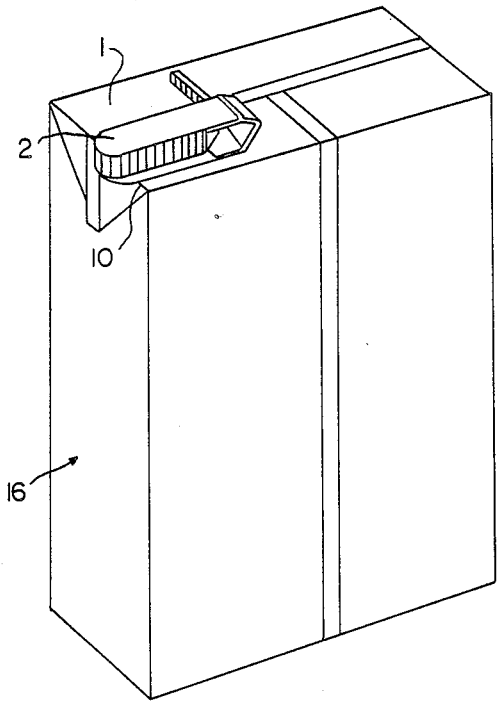
FIG. 1 is a perspective view of a container in accordance with the invention.
Figure 2A:
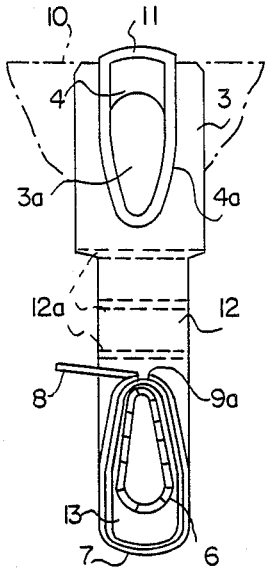
FIGS. 2*a* through 2*d* illustrate pour-out structures in various positions and from various points of view.
Figure 2B:
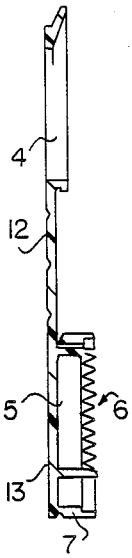

The parallelepipedal flat-gabled package illustrated in FIG. 1 is an eared package and to that extent state of the art. In accordance with the invention, the surface 1 of the package gable has a closeable pour-out structure 2 mounted on it as far in one corner as possible. Pour-out structure 2 is illustrated in detail in FIGS. 2 and 3. It is in one piece and consists of a tab or flange 3 sealed to the surface 1 of the gable. Tab 3 is essentially rectangular, has a slightly oval, raindrop-shaped opening 3*a*, and is demarcated by an essentially vertically elevated spout 4 that terminates in a collar 4*a*. A plug in the form of a tube 5 has triangular teeth 6 on its free face, and is secured to a closure-flap cap 13. Closure-flap cap 13 is flat and slightly elevated and is secured to tab 3 by a connecting strip 12 with three hinges 12*a*. Between the collar 4*a* on spout 4 and closure-flap cap 13, an essentially annular safety ring 7 acts as a spacer between the closure-flap cap and the eventual pouring hole. Secured to safety ring 7 is a pull tab 8 that can be activated to first destroy a tear notch and then draw safety ring 7 along a tear line and remove it. Spout 4 is positioned in one corner of the surface 1 of the gable and drawn out toward the narrow side 16 of the package and by way of the edge 10 of the package into a sharp-edged lip with its free end in the form of a rip-off edge 11. When the package is reclosed, closure-flap cap 13 comes to rest against surrounding collar 4*a*.

The embodiment illustrated in FIGS. 3*a* through 3*d* differs only in that a wedge or pin 19 is secured to the inside of the closure-flap cap and extends through the center of the tube and beyond the face of triangular teeth 6 and in that, when the package is reclosed, the annular extension 7*a* on safety ring 7 that remains on closure-flap cap 13 encloses continuous collar 4*a*.

Figure 2C:
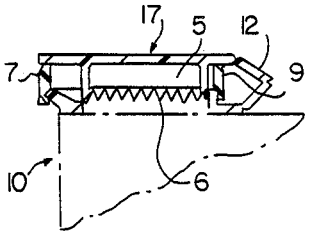
Figure 2D:
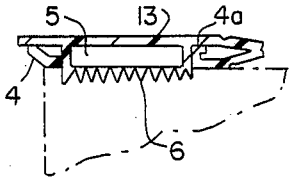
Figure 7A:
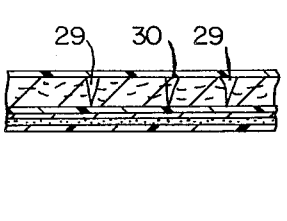
FIGS. 4*a*, 4*b*, 5*a*, 5*b*, 6*a*, 6*b*, 7*a*, and 7*b* are sections through and top views of the eventual pouring holes.
Figure 7B:
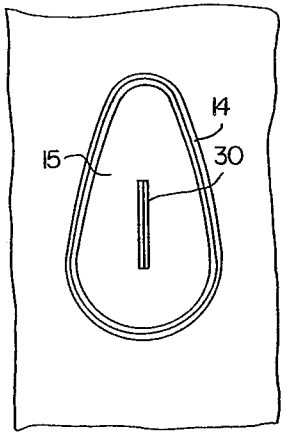

How the closure is activated will now be described. Pull tab 8 is pulled to destroy tear notch 9*a* and separate safety ring 7 along tear line 9. Force is applied to the surface 17 of closure-flap cap 13 to displace it and tube 5, whereupon teeth 6 penetrate and open pouring hole 15, optionally along line of separation 14 (FIG. 7). FIGS. 2*c* and 3*c* illustrate the situation before penetration and FIGS. 2*d* and 3*d* the situation after penetration. The recloseable pour-out structures with the wedge or pin 19 through the center of tube 5 illustrated in FIGS. 3*a* through 3*d* can be employed in particular in conjunction with the package illustrated in FIGS. 7*a* and 7*b*. In addition to line of separation 14, which is an opening 29 punched halfway through from the outside in FIG. 7*a*, there is another halfway-through longitudinal incision through the center of the raindrop shape established by line 14. When closure-flap cap 13 is forced down, wedge or pin 19 will come into contact with halfway-through opening 30, will penetrate and separate the other layers as it proceeds, and will finally act like a barb to secure the area punched out along line of separation 14 by teeth 6. Once it has been forced down, the closure-flap cap will either rest against the collar 4*a* on the pour-out structure (spout 4) as illustrated in FIG. 2*d* or its annular extension 7*a* will also surround collar 4*a* as illustrated in FIG. 3*d*.

Figure 3A:
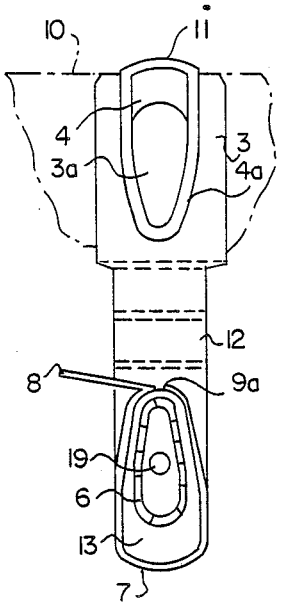
FIGS. 3*a* through 3*d* illustrate similar pour-out structures with a wedge or pin in the center of the tube.
Figure 3B:
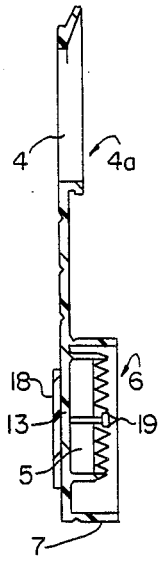
Figure 3C:
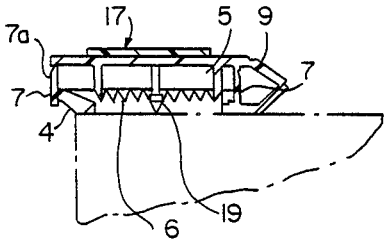
Figure 3D:
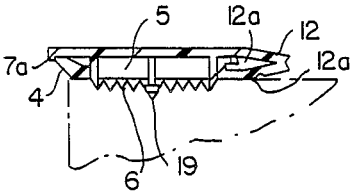

A further embodiment is illustrated in FIG. 3*b*. A support 18 that is part of an adhesive closure (with burdock-type barbs) is mounted on the surface 17 of closure-flap cap 13. This pendant is positioned in the corner of the gable where surface 17 comes to rest when closure-flap cap 13 is folded completely down.

FIGS. 4*a* and 4*b* through 7*a* and 7*b* illustrate the structure of the package and of the eventual pouring hole 15. With the exception of the eventual pouring opening, the aseptic package is made of a multilayer aluminum composite, with a layer 21 of polyethylene on the outside, followed by a layer 22 of cardboard, another layer 23 of polyethylene, a layer 24 of aluminum, an adhesion promoter 25, and a third layer (inner plastic coating) 26 of polyethylene on the inside. The layer 22 of cardboard has been removed from the vicinity of the eventual pouring hole 15 in the embodiment illustrated in FIG. 4*a* and the composite layers then applied on-line in the extruder.

Figure 5A:
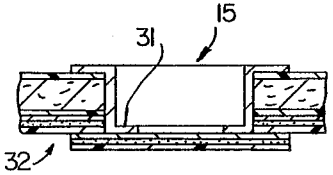
Figure 5B:
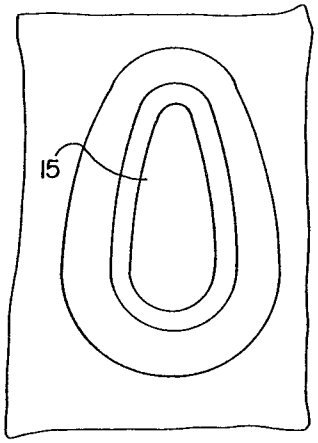

The pouring opening in the embodiment illustrated in FIG. 5*a* has been established in the laminate sealer in the finished composite, which is essentially identical with that of the rest of the package and consists of layers 31 and 32.

Figure 6A:
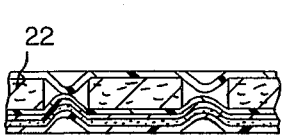
Figure 6B:
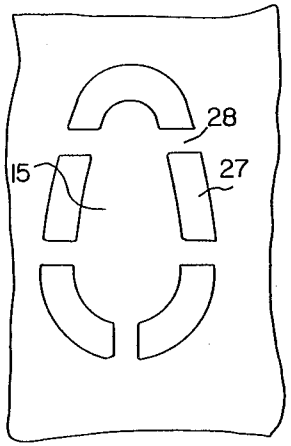
Figure 4A:
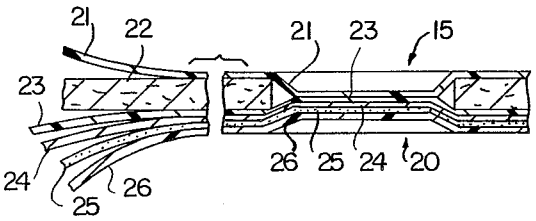
Figure 4B:
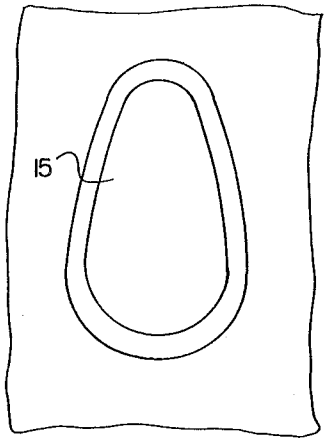

FIGS. 6*a* and 6*b* illustrate another version of the composite illustrated in FIG. 4*a*, wherein layer 22 of cardboard has a ring interrupted by a few intact webs 28 punched into it.

An eventual hole has been established by punching openings 29 and 30 halfway through the finished composite illustrated in FIGS. *7a* through *7b* from outside with a rotary die.

The package in accordance with the invention is especially outstanding for its high antipilfering and tamper-proof properties at no sacrifice of basic tightness or reliability of reclosure.

It is understood that the specification and examples are illustrative but not limitative of the present invention and that other embodiments within the spirit and scope of the invention will suggest themselves to those skilled in the art.

What is claimed is:

1. In a parallelepipedal flat-gabled package, such as an eared package, having a medial seam, an area in the gable that has been prepared such that it can be penetrated or separated along a closed curve and, once it has been penetrated or separated, will constitute a pouring hole, a plastic pour-out structure that has a flange surrounding the pouring hole, rigidly secured to the outer surface of the gable, and into the spout of which can be axially inserted a tube with a circumference that matches the closed curve and a number of triangular teeth along the surface that faces the pouring hole, and a cap that can be repeatedly employed to close the spout, the inner surface of the package being coated with a hot-adhering film of plastic, the improvement wherein the closure-flap cap is securely attached to the tube and is articulated to the tab on the pour-out structure, which is in the form of a spout.

2. A flat-gabled package according to claim 1, wherein the cap on the closure flap is secured to a releasable safety ring in such a way that the ring keeps the face of the tube with the triangular teeth away from the separating line or from the pouring hole in the gable.

3. A flat-gabled package according to claim 1, wherein the safety ring completely surrounds the collar of the spout.

4. A flat-gabled package according to claim 1, wherein a pull tab is secured to the safety ring and can be pulled to extract the ring along a tear line.

5. A flat-gabled package according to claim 1, wherein the pull tab is secured where the closure-flap ca is fastened to the connecting strip on the safety ring with a tear notch preferably next to it.

6. A flat-gabled package according to claim 1, wherein the spout and the pouring hole have a slightly oval and raindrop-shaped cross-section.

7. A flat-gabled package according to claim 1, wherein the spout is positioned in one corner of the surface of the gable and has a sharp-edged and drawn-out lip that extends beyond the edge of the narrow side of the package with its free end in the form of a rip-open edge.

8. A flat-gabled package according to claim 1, wherein the closed closure-flap cap completely surrounds the collar, including the rip-open edge.

9. A flat-gabled package according to claim 1, wherein the connecting strip is a three-part strap hinge that allows the closure-flap cap to pivot 180°.

10. A flat-gabled package according to claim 1, wherein the strap hinge is in the form of an articulated arm with two dead centers, one with the closure-flap cap closed and the other with the cap open.

11. A flat-gabled package according to claim 1, wherein the surface of the closure-flap cap that faces away from the pouring hole and the outer surface of the gable, which comes to rest when the cap is completely folded up or around, has strip-shaped supports that function as an adhesive closure.

12. A flat-gabled package according to claim 1, wherein the tube and the pouring channel inside the spout are slightly conical.

13. A flat-gabled package according to claim 1, wherein the inside of the closure-flap cap has a projection in the center of the tube and extending beyond the face of the tube.

14. A flat-gabled package according to claim 1, wherein the closure-flap cap and the tube, the pour-out structure consisting of the spout and the tab and at least one of the connecting strip are made of one piece of soft extruded plastic.

15. A flat-gabled package according to claim 1, wherein the tab is secured to the outside of the gable.

16. A flat-gabled package according to claim 1, wherein the inner surface of the package is coated with polyethylene that, before the package is opened, extends over the area that will become the pouring hole and over the line of separation.

17. A flat-gabled package according to claim 1, wherein the package is made of a multilayer aluminum composite, with a layer of polyethylene on the outside, followed by a layer of cardboard, another layer of polyethylene, a layer of aluminum, an adhesion promoter, and a third layer of polyethylene on the inside.

18. A flat-gabled package according to claim 1, wherein, before the package has been opened for the first time, the pouring hole has a continuous coating of polyethylene extruded onto the outside and onto the inside but no layer of cardboard.

19. A flat-gabled package according to claim 1, wherein, before the package has been opened for the first time, the outside and inside of the pouring hole are covered with thin sealed-on sheets.

20. A flat-gabled package according to claim 1, wherein, before the package has been opened for the first time, the eventual pouring hole consists of a layer of cardboard with a discontinuous ring punched into it, leaving webs of material intact, and coated.

21. A flat-gabled package according to claim 1, wherein, before the package has been opened for the first time, the eventual pouring hole is punched halfway through from outside in the shape of a ring.

22. A flat-gabled package according to claim 1, wherein the inside of the closure-flap cap has a projection in the center of the tube and extending beyond the face of the tube and a line is punched halfway through the center of the eventual pouring hole from outside.

23. A flat-gabled package according to claim 1, wherein the closed closure-flap completely covers the collar, including the rip-open edge.

* * * * *